US005082745A

United States Patent [19]

Ohashi

[11] Patent Number: 5,082,745

[45] Date of Patent: Jan. 21, 1992

[54] RARE EARTH BASED PERMANENT MAGNET HAVING CORROSION-RESISTANT SURFACE FILM AND METHOD FOR THE PREPARATION THEREOF

[75] Inventor: Ken Ohashi, Fukui, Japan

[73] Assignee: Shin-Etsu Chemical Co., Ltd., Tokyo, Japan

[21] Appl. No.: 620,885

[22] Filed: Nov. 29, 1990

[30] Foreign Application Priority Data

Nov. 30, 1989 [JP] Japan ..... 1-311589

[51] Int. Cl.[5] ..... B22F 3/00

[52] U.S. Cl. ..... 428/552; 419/27; 420/127

[58] Field of Search ..... 419/27; 428/552; 427/127

[56] References Cited

U.S. PATENT DOCUMENTS 4,931,092 6/1990 Cisar et al. ..... 419/27

*Primary Examiner*—Stephen J. Lechert, Jr.

*Attorney, Agent, or Firm*—Wenderoth, Lind & Ponack

[57] ABSTRACT

A highly corrosion-resistant rare earth-, e.g., neodymium-, based sintered permanent magnet is proposed which is characterized by the specific chemical composition of the magnet alloy including cobalt and/or chromium in a specified atomic percentage, by the density of the sintered body of at least 95% of the density of the alloy ingot and by the corrosion-resistant surface film formed on the surface of the sintered body by a specific method. By virtue of the favorable conditions against corrosion including the specific chemical composition of the magnet alloy and the high density of the sintered body, these conditions are also favorable for enhancing the adhesion of the corrosion-resistant coating film to the surface of the sintered body.

5 Claims, No Drawings

RARE EARTH BASED PERMANENT MAGNET HAVING CORROSION-RESISTANT SURFACE FILM AND METHOD FOR THE PREPARATION THEREOF

BACKGROUND OF THE INVENTION

The present invention relates to a rare earth-based permanent magnet having a corrosion-resistant surface film and a method for the preparation thereof. More particularly, the invention relates to a permanent magnet based on neodymium, iron and boron and provided with a highly corrosion- and oxidation-resistant surface coating film.

As is known, permanent magnets of the composition based on neodymium, iron and boron as the principal constituent elements, hereinafter referred to as the Nd-Fe-B magnets, as a class of the rare earth-based permanent magnets have several advantages, as compared with conventional samarium- and cobalt-based permanent magnets, in respect of the high magnetic performance and absence of limitation in the availability of neodymium as one of the essential constituents. Therefore, the demand for such Nd-Fe-B magnets is rapidly growing along with the expansion in the application fields of such high-performance magnets including electric motors, actuators, sensors and the like, in particular, as electric parts in automobiles as one of the various application fields. A very serious drawback in these Nd-Fe-B magnets is that the corrosion resistance or oxidation resistance of the magnet, which can be a powder-metallurgically prepared sintered magnet or a so-called plastic magnet, is even worse than iron metal so that it is eagerly desired to develop a highly corrosion-resistant Nd-Fe-B magnet. Various attempts and proposals have been made but none of them can give satisfactory results.

Several methods have been proposed for the improvement of the corrosion resistance of the Nd-Fe-B magnets by the further addition of an adjuvant element to the magnetic composition [see, for example, Japanese Patent Kokai 59-64733 and 59-132104 and B. E. Higgind and H. Oesterreicher, IEEE Trans. Mag. MAG-23, 92 (1987)]. The adjuvant elements hitherto proposed include chromium, nickel, titanium and others, but addition of these elements, through very effective in improving the corrosion resistance of the magnet, is detrimental to the magnetic properties of the Nd-Fe-B magnet so that the amount of these adjuvant elements in the magnetic composition is limited to a very low amount and the advantageous improvements as desired by the addition thereof can hardly be obtained as a consequence.

Alternatively, it is proposed to provide the surface of a Nd-Fe-B magnet with a surface coating film of a material having corrosion resistance. For example, such a corrosion-resistant coating film is formed by electrolytic or electroless nickel plating, aluminum-ion chromating, spray coating of an epoxy resin, electrodeposition of an epoxy resin and the like [see, for example, Japanese Patent Kokai 60-63903, 60-54406, 60-63902 and 60-63901 and Papers in Research Meeting for Applied Magnetics, MSJ 58-9, 59 (1989)]. Each of these methods can be used in several particular applications and the technology in this regard has reached a stage where these methods are somehow practically applicable although not quite satisfactory results can be obtained in respect of the adhesion of the coating film to the substrate surface and the corrosion resistance obtained thereby, leaving problems for further improvements. It is known that, when a sintered Nd-Fe-B magnet is provided with a metal plating or resin coating, the corrosion resistance of the magnet obtained thereby greatly depends on the surface condition of the sintered body. For example, the corrosion resistance is decreased when the surface has an oxidized layer or working-degraded layer having poor magnetic properties or pores.

SUMMARY OF THE INVENTION

The present invention accordingly has an object to provide a highly corrosion-resistant rare earth-based permanent magnet or a sintered Nd-Fe-B magnet by providing the surface of the magnet with a corrosion-resistant surface coating film, on the basis of the investigations undertaken in both regards for the magnetic composition of the magnet and for the method for forming the coating film.

Thus, the rare earth-based sintered permanent magnet having a corrosion-resistant surface film provided by the invention comprises, as an integral body:

(a) a powder-metallurgically sintered anisotropic body having a chemical composition consisting, in atomic percentages, of from 13 to 16% of a rare earth element, from 6 to 8% of boron, from 1 to 5% of cobalt, chromium or a combination thereof and from 0.5 to 2% of a metallic element selected from the group consisting of aluminum, niobium, molybdenum and titanium, the balance being iron and other unavoidable impurity elements, and having a density of at least 95% of the true density; and (b) a coating film formed on the surface of the sintered body from a material having resistance against corrosion and oxidation.

In particular, the coating film is formed by the electrolytic plating of nickel, electroless plating of nickel or electrodeposition of an epoxy resin following pre-treatment of the surface with zinc phosphate.

DETAILED DESCRIPTION OF THE PREFERRED EMBODIMENTS

As is described above, the corrosion-resistant rare earth-based magnet of the invention is characterized by the specific composition of the sintered body and the density thereof which is at least 95% of the true density. The inventor's unexpected discovery is that, when and only when these requirements are satisfied, the corrosion-resistant surface film can be imparted with sufficiently strong adhesion to the substrate surface to exhibit quite satisfactory protecting effect against oxidation and corrosion of the magnet. In particular, the protecting effect of the surface coating film can be superior to be practically applicable when the film is formed by a wet process.

The anisotropically sintered body of the magnetic alloy is composed of several elements including (1) a rare earth element, (2) boron, (3) cobalt, chromium or a combination thereof, (4) a metallic element selected from the group consisting of aluminum, niobium, molybdenum and titanium and (5) iron and other unavoidable impurity elements each in a specified amount.

The rare earth element as the first ingredient of the magnetic composition includes yttrium and the elements having an atomic number of 57 through 71, i.e. lanthanum, cerium, praseodymium, neodymium, samarium, europium, gadolinium, terbium, dysprosium, holmium, erbium, thulium, ytterbium and lutetium. These rare earth elements can be used either singly or as a combination of two kinds or more according to need. It is, however, preferable that all or a substantial fraction of the rare earth metal component is neodymium. The amount of the rare earth element or elements in the magnetic composition of the sintered body should be in the range from 13 to 15% in atomic percentage. When the proportion of the rare earth elements is too small, the sintered body can hardly be imparted with a high density reaching 95% of the true density so that the coercive force of the magnet would be unduly low. When the proportion of the rare earth elements is too large, on the other hand, the magnetic alloy is highly susceptible to air oxidation so that oxidation of the alloy proceeds during the step of pulverization of the alloy ingot resulting in a decrease in the saturation magnetization of the magnet.

The second ingredient in the magnetic composition is boron which should be contained in an amount in the range from 6 to 8% in the atomic percentage. When the proportion of boron is too small, the sintered magnet cannot be imparted with a high coercive force while, when it is too large, the saturation magnetization of the sintered magnet may be unduly decreased.

The third ingredient in the magnetic composition is cobalt, chromium or a combination thereof contained in an amount in the range from 1 to 5% in atomic percentage. These elements contribute to the improvement of the corrosion resistance of the sintered magnet so that sufficient corrosion resistance cannot be imparted to the magnet when the amount thereof is too small. No further improvement can be obtained, on the other hand, in the corrosion resistance even by increasing the amount of these elements in excess of the above mentioned upper limit, rather an adverse influence occurs on the coercive force and saturation magnetization of the magnet.

The fourth ingredient in the magnetic composition is a metallic element or combination of elements selected from the group consisting of aluminum, niobium, molybdenum and titanium contained in an amount in the range from 0.5 to 2% in atomic percentage. These elements contribute to the improvement of the coercive force while such an improvement cannot be obtained when the amount of these elements is too small. No further improvement in the coercive force can be obtained, however, by increasing the amount of these elements in excess of the above mentioned upper limit, rather an adverse influence occurs on the saturation magnetization.

The balance of the above described four classes of the elements includes iron and unavoidable impurity elements, the amount of which usually can be small by using a sufficiently high purity metallic material for each of the essential elements.

As is known, a sintered Nd-Fe-B magnet consists of three different phases including a matrix phase of the chemical composition of the formula $Nd_2Fe_{14}B$, a phase rich in the content of the rare earth element and a phase rich in the content of boron expressed by the formula $NdFe_4B_4$. The third ingredient, i.e. cobalt and/or chromium, introduced into the sintered magnetic composition is preferentially taken into the second phase rich in the content of the rare earth element, which is otherwise less corrosion-resistant than the other phases, to exhibit a remarkable effect for improving the corrosion resistance of the phase even when the amount thereof is relatively small.

It should be noted that, despite the substantial improvement in the corrosion resistance, the sintered magnet body having the above defined chemical composition still does not have quite satisfactory corrosion resistance from the practical standpoint, requiring a corrosion-resistant surface coating thereon. An unexpected discovery by the inventor is that adhesion of such a surface coating film to the substrate surface is greatly influenced not only by the properties of the coating film per se but also by the chemical composition of the sintered substrate body and the surface condition thereof. In particular, the surface of the sintered magnet body should desirably be free from pores as far as possible since occurrence of pores on the surface is very detrimental to the corrosion resistance of the sintered body per se as well as to the adhesion of the corrosion-resistant coating film to the substrate surface. Pores once formed on the surface of the sintered body can hardly be removed even by undertaking a pretreatment of the sintered body such as grinding, polishing, acid washing and the like. The investigations undertaken to decrease the number of surface pores have led to a conclusion that a substantial decrease in the number of pores can be achieved by increasing the density of the sintered body. For example, the number of surface pores can be greatly decreased when the sintered body has a density of at least 95% of the true density which means the density of the alloy ingot having the same chemical composition of the elements as the sintered body. When the density of the sintered body is smaller than 95% of the true density, the corrosion-resistant coating film formed on the surface of the sintered body cannot be fully adherent thereto and does not exhibit a high protecting effect against corrosion or oxidation of the sintered body even by the addition of cobalt and/or chromium having an improving effect on the corrosion resistance. When cobalt and/or chromium are added to the magnetic alloy composition, an advantage is obtained that fine particles of the alloy powder are less susceptible than otherwise to the oxidation by the atmospheric oxygen in the course of pulverization of the alloy ingot, contributing to an increase in the density of the sintered body and decrease of the oxygen content therein.

As to the material of the coating film to be formed on the surface of the sintered magnet body, it is a remarkable fact that good adhesion can be obtained between the substrate surface and various kinds of coating materials provided that the sintered magnet body has a chemical composition specified above and the density thereof is at least 95% of the true density. Conventionally, a corrosion-resistant coating film on the surface of a sintered magnet is formed by the electrolytic or electroless nickel plating, aluminum-ion chromating, spray coating with an epoxy resin, electrodeposition of an epoxy resin with or without pretreatment with zinc phosphate and the like. In the invention, particularly good results can be obtained by the electrodeposition of a resin after a pretreatment with zinc phosphate or electrolytic or electroless nickel plating. The thickness of the nickel plating layer, either by the electrolytic process or by the electroless process, should be in the range from 8 to 20 μm and the overall coating thickness in the electrodeposition of an epoxy resin including the undercoating of zinc phosphate should be in the range from 10 to 30 μm.

The reason for the very satisfactory results obtained by the inventive method is presumably that, when the coating film is formed on the substrate surface by these wet-process methods, the pretreatment of the sintered body such as polishing, acid washing and the like, is also conducted in a wet condition so that the chance of exposure of the surface of the sintered magnet body to air is minimized to keep the surface in an unoxidized condition. In particular, the rare earth-based sintered magnet of the invention can be imparted with very high corrosion resistance as a consequence of the synergistic effect of several features, namely that the sintered body of the magnet has only very few pores which might greatly affect the corrosion resistance of the magnet, the crystallographic phase rich in the rare earth element, which is the most susceptible to corrosion, is imparted with enhanced corrosion resistance by the addition of cobalt and/or chromium, the sintered body has a high density of at least 95% of the true density due to the decrease in the content of oxygen, which is usually contained in a high concentration in the rare earth-rich phase, by virtue of the decreased overall amount of oxygen due to the addition of cobalt and/or chromium, and so on.

The sintered body for the inventive anisotropic rare earth-based permanent magnet is prepared by the powder metallurgical process conventionally undertaken in the art. Namely, the respective elements of the composition each in the metallic form are taken by weighing and melted together under an inert atmosphere and the alloy melt is cast in a mold to give an ingot which is crushed and finely pulverized in an atmosphere of an inert gas into fine particles having an average particle diameter of 3 to 5 μm. The thus obtained magnetic alloy powder is compression-molded in a magnetic field in order to orient the particles to have the axis of easy magnetization aligned in parallel to the direction of the magnetic field to give a green body or powder compact. The green body is subjected to a heat treatment first at 1000° to 1100° C. to be sintered and then at 500° to 700° C. for aging to give the desired anisotropic sintered permanent magnet. It is important that each of the above described steps is conducted under appropriately controlled conditions in order to obtain a sufficiently high density of the sintered body. In particular, it is a quite unexpected discovery that high corrosion resistance of the magnet can be obtained only when the density of the sintered magnet body has a density of at least 95% of the true density and the sintering temperature therefor should preferably be in the range from 1010° to 1100° C.

In the following, examples are given to illustrate the invention in more detail but not to limit the scope of the invention in any way.

EXAMPLE 1

Several ingots of neodymium-containing rare earth-based magnetic alloys having a chemical composition expressed by the formula $Nd_{15}(Fe_{1-x}Co_x)_{78.2}B_6Al_{0.8}$, in which x is a positive number in the range from 0.02 to 0.06 corresponding to the content of cobalt in atomic percentage of 1.56 to 4.69%, were prepared from metals of iron, cobalt and aluminum each having a purity of about 99.9% and neodymium and boron each in the metallic form having a purity of about 99%. Each alloy ingot was pulverized in a jet mill using nitrogen as the jet gas into a fine powder having an average particle diameter of 3 to 4 μm and the powder was compression-molded in a magnetic field of 15 kOe to align the particles to give a powder compact. The powder compact was subjected to a heat treatment first at varied temperatures in the range from 1000° to 1100° C. to effect sintering and then at 500° to 650° C. to effect aging. The thus obtained sintered magnet bodies had a density shown in Table 1 below by the ratio to the density of the ingot which was about 7.60. For comparison, another sintered magnet body was prepared in the same manner as above except that the cobalt in the formulation was omitted or, namely, the subscript x in the above given formula was zero.

Each of the thus prepared sintered bodies was mechanically worked into a disc having a diameter of 20 mm and a thickness of 1.5 mm, which was electrolytically plated with nickel in a plating thickness of 10 μm. The electrolytic plating process was preceded by the pretreatment of the disc including the successive steps of alkali degreasing, washing with water, neutralization, washing with water, washing with an acid and washing again with water and succeeded by the post-treatment including the steps of washing with water and drying. The electrolyte solution having a pH of 4.5 to 6.0 contained 240 g/liter of nickel sulfate $NiSO_4$, 45 g/liter of nickel chloride $NiCl_2$, 30 g/liter of boric acid $H_3BO_3$ and a small amount of a lustering agent. The electrolytic plating was performed at 45° to 60° C. with a cathodic current density of 0.6 to 2.0 $A/dm^2$.

The thus nickel-plated magnets were introduced into an autoclave and heated there for 100 hours in pressurized steam of 2 atmospheres at 120° C. for an accelerated corrosion test. The results of the corrosion test were evaluated in terms of the appearance relative to the condition of the nickel plating layer such as lifting and the decrease in % in the magnetic flux density after the accelerated corrosion as compared with the initial value. The results are shown in Table 1, in which the results of the appearance test are given in five ratings including: A for excellent resistance without noticeable changes in the appearance; B for the appearance of very little rust at or around pin holes; C for the appearance of rust and lifting of the plating layer at the edges; D for the appearance of rust and lifting of the plating layer not only at the edges but also on the flat surfaces; and E for the appearance of cracks and lifting of the plating layer over the whole surface.

As is clear from the results shown in Table 1, the corrosion resistance of the magnet was very poor when the magnet alloy contained no cobalt irrespective of the density of the sintered body. The corrosion resistance of the magnet was also poor when the sintered body had a density smaller than 95% of the ingot even when the magnet alloy contained a proper amount of cobalt.

TABLE 1

| Sample No. | Content of cobalt, atomic % (x in the formula) | Sintering temperature, °C. | Relative density, % | Decrease in magnetic flux, % | Change in appearance |
|---|---|---|---|---|---|
| 1 | 1.56 (0.02) | 1000 | 92.7 | 12.1 | D |
| 2 | 1.56 (0.02) | 1030 | 95.3 | 4.1 | B |
| 3 | 1.56 (0.02) | 1060 | 97.8 | 2.8 | B |
| 4 | 1.56 (0.02) | 1100 | 98.3 | 2.3 | B |
| 5 | 3.13 (0.04) | 1000 | 93.4 | 8.5 | C |
| 6 | 3.13 (0.04) | 1030 | 96.5 | 2.6 | B |
| 7 | 3.13 (0.04) | 1060 | 98.0 | 1.8 | A |
| 8 | 3.13 (0.04) | 1100 | 98.4 | 1.2 | A |
| 9 | 4.69 (0.06) | 1030 | 96.7 | 2.1 | B |
| 10 | 4.69 (0.06) | 1060 | 98.2 | 1.3 | A |
| 11 | 4.69 (0.06) | 1100 | 98.4 | 0.9 | A |
| 12 | 0.00 (0.00) | 1000 | 90.1 | 45.5 | E |

TABLE 1-continued

| Sample No. | Content of cobalt, atomic % (x in the formula) | Sintering temperature, °C. | Relative density, % | Decrease in magnetic flux, % | Change in appearance |
|---|---|---|---|---|---|
| 13 | 0.00 (0.00) | 1030 | 93.6 | 31.0 | E |
| 14 | 0.00 (0.00) | 1060 | 96.0 | 18.0 | D |
| 15 | 0.00 (0.00) | 1100 | 97.4 | 10.5 | C |

EXAMPLE 2

Ingots of several magnetic alloys having a composition expressed by the formula $(Nd_{0.92}Pr_{0.03}Dy_{0.05})_{15}(Fe_{1-x}Co_x)_{76}B_8Nb_1$, in which x had varied values of 0.02 to 0.06, were prepared from metals of iron, cobalt and niobium each having a purity of 99.9% and praseodymium, neodymium, dysprosium and boron each in a metallic form of 99% purity. Sintered permanent magnets were prepared from these magnetic alloy ingots in the same manner as in Example 1. For comparison, further sintered magnets were prepared in the same formulation and in the same manner as above except that cobalt in the formulation was omitted with the value of the subscript x in the formula equal to zero. The sintering temperature was 1080° C. or 1000° C.

Each of the sintered magnet bodies was shaped into the form of a disc having the same dimensions as in Example 1. The magnet discs were, after a pretreatment by shot blasting, coated first with a zinc phosphate layer having a thickness of 2 μm and then with an epoxy resin by electrodeposition in a coating thickness of 10 μm.

Table 2 below shows the results of the accelerated corrosion test for 20 hours undertaken in the same manner as in Example 1.

TABLE 2

| Sample No. | Content of cobalt, atomic % (x in the formula) | Sintering temperature, °C. | Relative density, % | Decrease in magnetic flux, % | Change in appearance |
|---|---|---|---|---|---|
| 16 | 1.52 (0.02) | 1000 | 92.7 | 15.5 | D |
| 17 | 1.56 (0.02) | 1080 | 98.0 | 4.8 | B |
| 18 | 3.04 (0.04) | 1000 | 93.4 | 10.2 | D |
| 19 | 3.04 (0.04) | 1080 | 98.3 | 2.9 | B |
| 20 | 4.56 (0.06) | 1080 | 98.4 | 2.2 | B |
| 21 | 0.00 (0.00) | 1000 | 90.1 | 59.0 | E |
| 22 | 0.00 (0.00) | 1080 | 96.8 | 3.0 | E |

What is claimed is:

1. A rare earth-based sintered permanent magnet having a corrosion-resistant surface film which comprises, as an integral body:

(a) a powder-metallurgically sintered anisotropic body having a chemical composition consisting, in atomic percentages, of from 13 to 16% of a rare earth element, from 6 to 8% of boron, from 1 to 5% of cobalt, chromium or a combination thereof and from 0.5 to 2% of a metallic element selected from the group consisting of aluminum, niobium, molybdenum and titanium, the balance being iron and other unavoidable impurity elements, and having a density of at least 95% of the true density; and (b) a coating film formed on the surface of the sintered body from a material having resistance against corrosion and oxidation.

2. The rare earth-based sintered permanent magnet having a corrosion-resistant surface film as claimed in claim 1 in which the coating film is formed by electrolytic plating of nickel, electroless plating of nickel or electrodeposition of an epoxy resin following a pre-treatment of the surface of the sintered body with zinc phosphate.

3. The rare earth-based sintered permanent magnet having a corrosion-resistant surface film as claimed in claim 2 in which the coating film has a thickness in the range from 8 to 20 μm when the coating film is formed by the electrolytic plating or electroless plating of nickel, or a thickness in the range from 10 to 30 μm when the coating film is formed by the electrodeposition of an epoxy resin including the layer formed by the pre-treatment with zinc phosphate.

4. A method for the preparation of a rare earth-based sintered permanent magnet having a corrosion-resistant surface film which comprises the steps of:

(A) pulverizing an ingot of an alloy having a chemical composition consisting, in atomic percentages, of from 13 to 16% of a rare earth element, from 6 to 8% of boron, from 1 to 5% of cobalt, chromium or a combination thereof and from 0.5 to 2% of a metallic element selected from the group consisting of aluminum, niobium, molybdenum and titanium, the balance being iron and other unavoidable impurity elements into a powder of fine particles;

(B) compression-molding the powder in a magnetic field into a powder compact;

(C) sintering the powder compact by heating at a temperature in the range from 1010° C. to 1100° C. into a sintered body having a density of at least 95% of the density of the ingot; and (D) forming, on the surface of the sintered body, a coating film formed from a material having resistance against corrosion and oxidation.

5. The method for the preparation of a rare earth-based sintered permanent magnet having a corrosion-resistant surface film as claimed in claim 4 in which the coating film is formed by electrolytic plating of nickel, electroless plating of nickel or electrodeposition of an epoxy resin following a pre-treatment of the surface of the sintered body with zinc phosphate.

* * * * *